US009103340B2

(12) United States Patent
Wagner

(10) Patent No.: US 9,103,340 B2
(45) Date of Patent: Aug. 11, 2015

(54) PERISTALTIC PUMP AND HOSE CARTRIDGE THEREFOR

(75) Inventor: Heinz Wagner, Zurich (CH)

(73) Assignee: SWAN ANALYTISCHE INSTRUMENTE AG, Hinwil (CH)

( * ) Notice: Subject to any disclaimer, the term of this patent is extended or adjusted under 35 U.S.C. 154(b) by 501 days.

(21) Appl. No.: 13/503,754

(22) PCT Filed: Nov. 11, 2009

(86) PCT No.: PCT/EP2009/064986

§ 371 (c)(1),
(2), (4) Date: Apr. 24, 2012

(87) PCT Pub. No.: WO2011/057663

PCT Pub. Date: May 19, 2011

(65) Prior Publication Data

US 2012/0213653 A1 Aug. 23, 2012

(51) Int. Cl.
*F04B 53/22* (2006.01)
*F04B 43/12* (2006.01)

(52) U.S. Cl.
CPC ..... *F04B 43/1292* (2013.01); *F04B 43/1253* (2013.01); *F04B 53/22* (2013.01); *Y10T 29/49236* (2015.01)

(58) Field of Classification Search
CPC ..... F04B 43/12; F04B 43/1292; F04B 53/22; F04B 43/1253; Y10Y 29/49236; Y10Y 29/4924
USPC ..... 417/477.9
See application file for complete search history.

(56) References Cited

U.S. PATENT DOCUMENTS

| | | | | |
|---|---|---|---|---|
| 5,230,614 | A * | 7/1993 | Zanger et al. | 417/477.9 |
| 5,846,061 | A | 12/1998 | Ledebuhr | |
| 7,223,079 | B2 * | 5/2007 | Ortega et al. | 417/53 |
| 2004/0057856 | A1 | 3/2004 | Saxer et al. | |

* cited by examiner

*Primary Examiner* — Charles Freay
*Assistant Examiner* — Philip Stimpert
(74) *Attorney, Agent, or Firm* — Notaro, Michalos & Zaccaria P.C.

(57) ABSTRACT

A hose cartridge for removably mounting a hose on a peristaltic pump has a roller wheel for pumping a fluid through the hose in a closed loop encircling an opening through which the roller wheel extends when the hose cartridge is mounted. A method for mounting such a hose cartridge includes introducing a holding rod of the pump into a holding portion of the hose cartridge, and carrying out a rotational movement of the hose cartridge about an axis defined by the holding rod until the working position of the hose cartridge is reached. The holding rod and the fixing bar both thus extend substantially parallel to the rotation axis of the roller wheel.

8 Claims, 5 Drawing Sheets

PERISTALTIC PUMP AND HOSE CARTRIDGE THEREFOR

TECHNICAL FIELD

The invention relates to a peristaltic pump and more particularly to a hose cartridge therefor. It relates to methods and apparatuses according to the opening clauses of the claims.

BACKGROUND OF THE INVENTION

Peristaltic pumps are well known and widely used in applications where a fluid to be pumped has to remain particularly clean, e.g., in water analytics. A hose of an elastic material and containing the fluid to be pumped is mounted in a hose cartridge having an occlusion surface, and the hose is located between said occlusion surface and rollers of a roller wheel of the peristaltic pump, such that when the roller wheel rotates, the fluid is transported within the hose. Generally, not only liquid or gaseous materials can be pumped this way, but also solid material such as granular materials. The pumping of liquids is of particular interest for the present invention.

From U.S. Ser. No. 2004/0057856 A1, a hose cartridge is known, which has a cantilever arm at which the occlusion surface is located. A screw provides a stop for the cantilever movement of the cantilever arm, thus allowing to adjust the pressure exterted on the hose when the cartridge is mounted on a corresponding peristaltic pump.

In U.S. Pat. No. 5,846,061, a multi channel peristaltic pump is presented.

SUMMARY OF THE INVENTION

One object of the invention is to create a new type of hose cartridge and a corresponding peristaltic pump. In addition, the respective method for mounting a hose cartridge onto a peristaltic pump shall be provided.

Another object of the invention is to provide a way to achieve a high precision and reproducibility in peristaltic pumping.

Another object of the invention is to provide a possibility to allow a simple mounting of a hose cartridge onto a peristaltic pump.

Another object of the invention is to provide a possibility to enable a high degree of reproducibility in mounting a hose cartridge onto a peristaltic pump.

Another object of the invention is to provide a peristaltic pump which can be provided with a relatively weak bearing for the rotation axis of the roller wheel while still being sufficiently sturdily designed.

Further objects emerge from the description and embodiments below.

At least one of these objects is at least partially achieved by apparatuses and methods according to the patent claims.

The hose cartridge is a hose cartridge for removably mounting a hose on a peristaltic pump comprising a roller wheel for pumping a fluid through said hose. Said hose cartridge substantially describes a closed loop encircling an opening through which said roller wheel extends when the hose cartridge is mounted on a peristaltic pump.

This provides a high degree of rigidness and mechanic stability while allowing a relatively small overall design using little material only.

Said hose typically is a flexible tube.

Said hose cartridge can also be considered a hose cartridge for mounting a hose on and unmounting a hose from a peristaltic pump.

Said roller wheel sometimes is also referred to as pump head.

In one embodiment, the hose cartridge is of generally ring-like shape, wherein "ring" does not imply a circular shape.

In one embodiment which is of particular importance and which may be combined with the before-addressed embodiment, said peristaltic pump is a rotary peristaltic pump and/or a tube pump.

In particular, during operation, said roller wheel rotates around a substantially fixed rotation axis and the active section of the hose describes an open loop, more particular a segment of a circle of less than 360°, typically less than 270°, more typically at most 180°. Under "active section", we understand that section of the hose which interacts with the roller wheel (i.e. which is compressed by the roller wheel) when the hose cartridge is mounted on a peristaltic pump and the peristaltic pump is in operation.

In one embodiment which may be combined with one or more of the before-addressed embodiments, said opening encircled by said closed loop is referred to as an opening for receiving the roller wheel, or shortly as "receiving opening". Said receiving opening can also be considered to be an open space surrounded by said closed loop into which the roller wheel is to be inserted In one embodiment which may be combined with one or more of the before-addressed embodiments, said closed loop surrounds an open space (receiving opening) into which the roller wheel is located during pumping operation.

In one embodiment which may be combined with one or more of the before-addressed embodiments, the hose cartridge substantially describes a closed loop in a plane, wherein, when the hose cartridge is mounted on a peristaltic pump, said plane is substantially perpendicular to a rotation axis of said roller wheel, and said hose is arranged substantially within said plane.

In one embodiment which may be combined with one or more of the before-addressed embodiments, at least three rollers are comprised in the roller wheel. Typically 4 or more or 5 or more are provided.

In one embodiment which may be combined with one or more of the before-addressed embodiments, the rollers of the roller wheel substantially are rotatable cylindrical members.

In one embodiment which may be combined with one or more of the before-addressed embodiments, the shape of the hose cartridge defines a cartridge plane, wherein said closed loop is arranged within said cartridge plane. When the hose cartridge is mounted on a peristaltic pump, a rotation axis of the roller wheel will be arranged substantially perpendicularly to said cartridge plane. With a hose inserted in the hose cartridge, the hose is generally arranged within said cartridge plane.

In one embodiment which refers to the before-addressed embodiment, the occlusion surface is aligned substantially perpendicularly to said cartridge plane.

In one embodiment which may be combined with one or more of the before-addressed embodiments, the direction of a lever movement of a lever member of the hose cartridge lies substantially within said cartridge plane (the lever member is described below in more detail).

In one embodiment which may be combined with one or more of the before-addressed embodiments, the hose cartridge is a hose cartridge for exactly one hose.

In one embodiment which may be combined with one or more of the before-addressed embodiments, the hose cartridge is at least substantially integrally formed or at least substantially consists of an integrally formed main part and an additional spring member or one or more parts of a spring member attached to said main part.

This allows for a simple manufacturing and for a sturdy design.

In one embodiment which may be combined with one or more of the before-addressed embodiments, said hose cartridge is made substantially of a polymer. Different materials or combinations of materials are possible, including a hose cartridge fully or partially of metal. The hose cartridge can be completely rigid except for at least a portion of a lever portion, where a degree of flexibility shall be provided; lever portions are discussed further below.

In one embodiment which may be combined with one or more of the before-addressed embodiments, the hose cartridge comprises a first frame section forming an occlusion surface having an at least substantially circular curvature and a second frame section neighboring said first frame section and forming a surface neighboring said occlusion surface and having a curvature less strong than said substantially circular curvature. This helps or enables to mount the hose cartridge on a peristaltic pump by means of a rotational movement.

In one embodiment referring to the before-addressed embodiment, said at least substantially circular curvature is arranged within a plane substantially perpendicular to a rotation axis of the roller wheel.

As to the occlusion surface: When the peristaltic pump is in operation, the hose is compressed between said occlusion surface and rollers of the roller wheel, or described differently, with the hose inserted in the hose cartridge, the active section of the hose is neighboring and in touch with said occlusion surface.

Said radius of said circular curvature is substantially determined by the outer diameter of the roller wheels and the wall thickness of the hose.

In one embodiment which may be combined with one or more of the before-addressed embodiments addressing the occlusion surface, the occlusion surface is substantially strip-like, more particularly, like a strip having said substantially circular curvature in the direction of its extension and being substantially flat (i.e. level) in the direction perpendicular to its extension.

In one embodiment which may be combined with one or more of the before-addressed embodiments, the hose cartridge comprises said hose.

In one embodiment which may be combined with one or more of the before-addressed embodiments, the hose cartridge comprises a holding portion for rotatably fixing the hose cartridge on a holding rod of a peristaltic pump.

This allows to mount the hose cartridge by a rotating movement.

In one embodiment referring to the before-addressed embodiment, said holding portion fully or partially encircles a shape substantially describing a cylinder jacket.

In particular, it partially encircles said shape by an angle of more than 180° and less than 315°. This allows to mount the hose cartridge on said holding rod by clamping.

In one embodiment which may be combined with one or more of the before-addressed embodiments, the hose cartridge comprises a spring member and a lever portion. Therein, said lever portion comprises

- a fixed end at which the lever portion is fixed to substantially the rest of the hose cartridge; and
- a spring-loaded end, spring-loaded by said spring member; and,
- at said spring-loaded end, a fixing surface; and,
- between said fixed end and said fixing surface and neighboring said fixing surface, a sliding surface;

wherein said fixing surface and said sliding surface form an angle of substantially larger than 180°.

This allows to reach a well-defined fixed position of the hose cartridge when mounting the hose cartridge on a peristaltic pump.

It is possible to dispense with a separate spring member and design said lever portion in such a way that a sufficiently large force can be exterted on the fixing bar by the lever portion alone, without an additional, separate spring member.

In particular, said angle amounts to more than 210°, and more particularly to more than 225°.

In one embodiment which may be combined with one or more of the before-addressed embodiments addressing said fixing surface, said fixing surface or at least its major portion is substantially flat.

In one embodiment which may be combined with one or more of the before-addressed embodiments addressing said fixing surface, a force exerted by spring member is directed generally perpendicularly to said fixing surface, in particular within 30°, more particularly within 20° perpendicularly thereto. Furthermore, said force is preferably directed along a direction lying generally within a plane perpendicular to the rotation axis of the roller wheel.

In one embodiment which may be combined with one or more of the before-addressed embodiments addressing said spring member and said lever portion, these are provided for securing the hose cartridge to a peristaltic pump, more particularly for securing the hose cartridge to a fixing bar of a peristaltic pump, and for allowing the fixing bar to slide along the sliding surface when bringing the hose cartridge into a fixed position or working position, in particular by rotating the hose cartridge, in particular about the above-mentioned holding rod. In the fixed position, the hose cartridge can be fixed in a clamping fashion.

The force by which the hose is compressed by the rollers of the roller wheels is determined by the force exerted by the spring member in conjunction with the lever portion, and can therefore be very well defined.

The fixing surface furthermore avoids a tilting of the hose cartridge. The fixing surface extends in a plane perpendicular to the cartridge plane, and its extension into a direction along the rotation axis of the roller wheel ensures, by interaction with said fixing bar, that the cartridge plane remains at least substantially perpendicularly to the rotation axis of the roller wheel. This applies in particular in conjunction with the above-mentioned holding portion.

The spring member together with the lever portion allows to ensure a defined tension on the hose, in particular in conjunction with the above-mentioned holding portion and holding rod. This relieves the roller wheel (more particularly its rotation axis) from mechanical tension, more particularly from forces likely to cause an axis tilt, thus allowing to design the peristaltic pump with relatively simple bearings for the rotation axis.

In one embodiment which may be combined with one or more of the before-addressed embodiments, the hose cartridge comprises an axial-positioning member, e.g., a protrusion or a protuding part such as a nose, e.g., near and/or opposite the fixing surface—for preventing a tilting of the hose cartridge with respect to the rotation axis of the peristaltic pump, when the cartridge is mounted on a peristaltic pump, and in particular during pumping operation of the peristaltic pump. Through such a tilting of the hose cartridge, the hose might become axially displaced such that it would discontinue being compressed between the rollers of the roller wheel and the occlusion surface, and thus, the pumping would be disturbed. Such an axial-positioning member can, e.g., interact with a fixing bar of the peristaltic pump.

In one embodiment which may be combined with one or more of the before-addressed embodiments, the hose cartridge comprises a stop member for preventing a too far rotation of the hose cartridge when mounting the hose cartridge, in particular wherein the stop member interacts with a fixing bar of the peristaltic pump.

It is possible to embody the axial-positioning member as a protrusion protuding from the stop member.

In one embodiment which may be combined with one or more of the before-addressed embodiments, the hose cartridge is substantially rigid (and remains substantially undeformed during mounting/unmounting to/from a peristaltic pump and during operation of the peristaltic pump), except for said spring member and said lever portion and possibly also except for said holding portion or a portion thereof.

The peristaltic pump comprises a roller wheel rotatable about a substantially fixed rotation axis, and at least one hose cartridge according to the invention and comprising a hose.

In one embodiment referring to the before-addressed embodiment, the peristaltic pump comprises a holding rod and a fixing bar, both aligned substantially parallel to said rotation axis, and a fixing plate mechanically interconnecting an end region of said holding rod, an end region of said fixing bar and an end region of said rotation axis.

This is for stabilizing the rotation axis and takes mechanical stress from the rotation axis.

When mounted on a peristaltic pump, the hose cartridge will usually be arranged (with respect to its axial position) between said fixing plate and a housing of the peristaltic pump, said housing at least containing a drive for rotating said rotation axis.

E.g., said fixing plate is substantially a flat piece of metal.

Viewed from a particular point of view, the invention comprises a peristaltic pump which comprises a roller wheel rotatable about a substantially fixed rotation axis and a holding rod and a fixing bar, both aligned substantially parallel to said rotation axis, and a fixing plate mechanically interconnecting an end region of said holding rod, an end region of said fixing bar and an end region of said rotation axis.

The invention generally comprises peristaltic pumps with features of corresponding hose cartridges according to the invention, and vice versa. The advantages of the peristaltic pumps basically correspond to the advantages of corresponding hose cartridges and vice versa.

The method is a method for mounting a hose cartridge comprising a hose onto a peristaltic pump comprising a roller wheel for pumping a fluid through said hose and a holding rod and a fixing bar. Therein, said holding rod and said fixing bar, both, extend substantially parallel to a rotation axis of said roller wheel. The method comprises the steps of b) introducing said holding rod into a holding portion of said hose cartridge;

c) carrying out a rotational movement of said hose cartridge about an axis defined by said holding rod until a working position of the hose cartridge is reached.

In one embodiment of the method, step b) comprises clamping said holding rod into said holding portion, in particular by pressing; more particularly by pressing the holding rod through an opening of said holding portion; in particular, said pressing is substantially accomplished by applying to the hose cartridge a force substantially perpendicular to said holding rod.

In one embodiment which may be combined with the before-addressed embodiment of the method, during step c), by means of said rotational movement, said fixing bar is slided over a sliding surface of a lever portion of the hose cartridge, and, by further rotating said hose cartridge about said axis defined by said holding rod, a fixing surface of said lever portion is pressed, by means of a spring member of said lever portion, against said fixing bar, thus holding said hose cartridge in said working position.

In one embodiment which may be combined with one or more of the before-addressed method embodiments, said hose cartridge comprises a receiving opening, and said method comprises, before step b), the step of a) moving said hose cartridge with said receiving opening over said rotation axis, said holding rod and said fixing bar, such that the latter extend through said receiving opening.

The invention generally comprises methods for mounting a hose cartridge onto a peristaltic pump with features of corresponding hose cartridges and/or peristaltic pumps according to the invention, and vice versa.

The advantages of the methods basically correspond to the advantages of corresponding apparatuses and vice versa.

Further embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. Generally, the same or alike parts are given the same reference symbols. The described embodiments are meant as examples and shall not confine the invention.

DETAILED DESCRIPTION OF THE INVENTION

Further above in the description, the hose cartridges and the peristaltic pumps have already been described in rather great detail. Therefore, and using the same terminology, in the following, the embodiments will partially be described rather roughly only. For further details, please refer to the text above.

Figure 1:
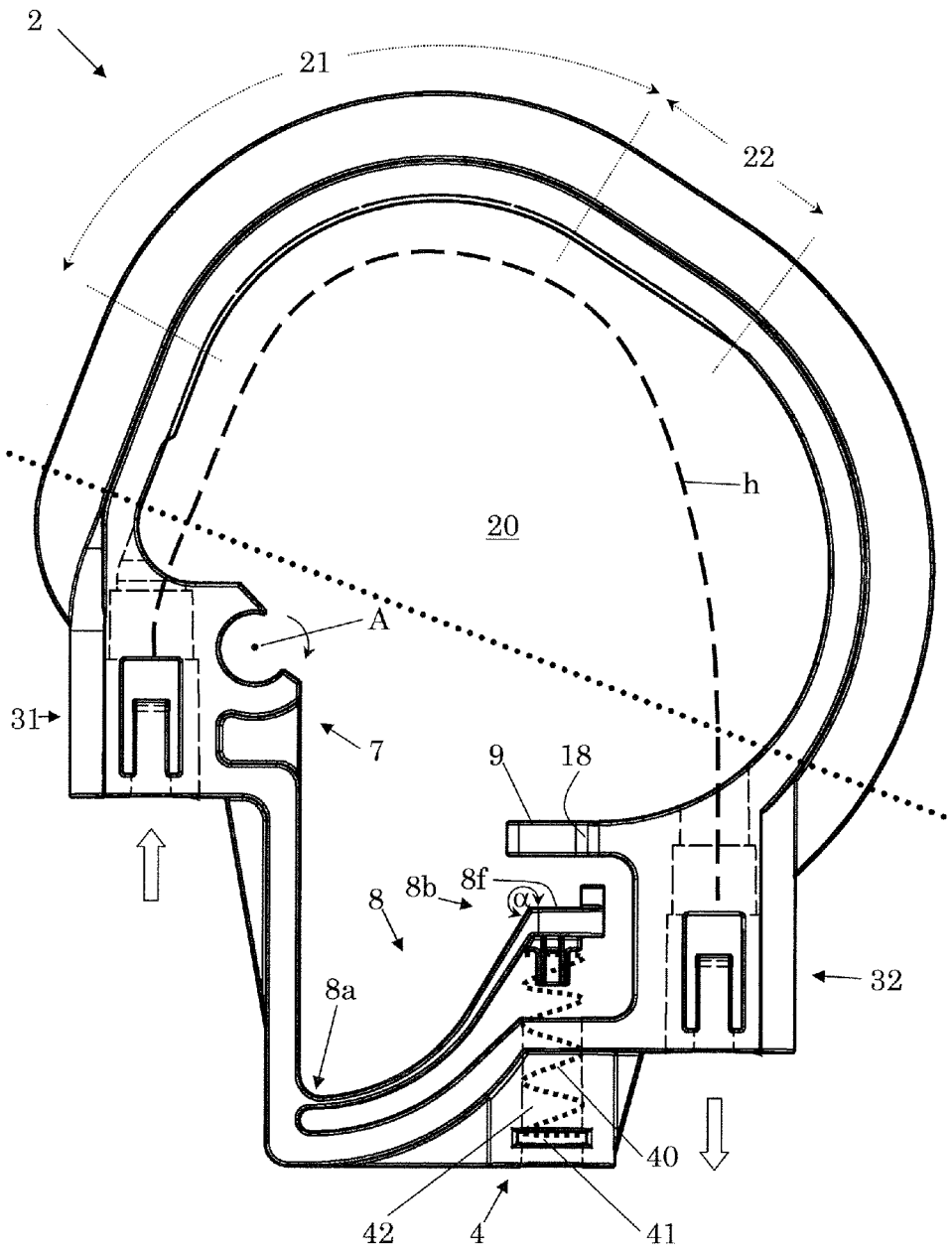
FIG. 1 a front view of a hose cartridge, no hose mounted.
Figure 2:
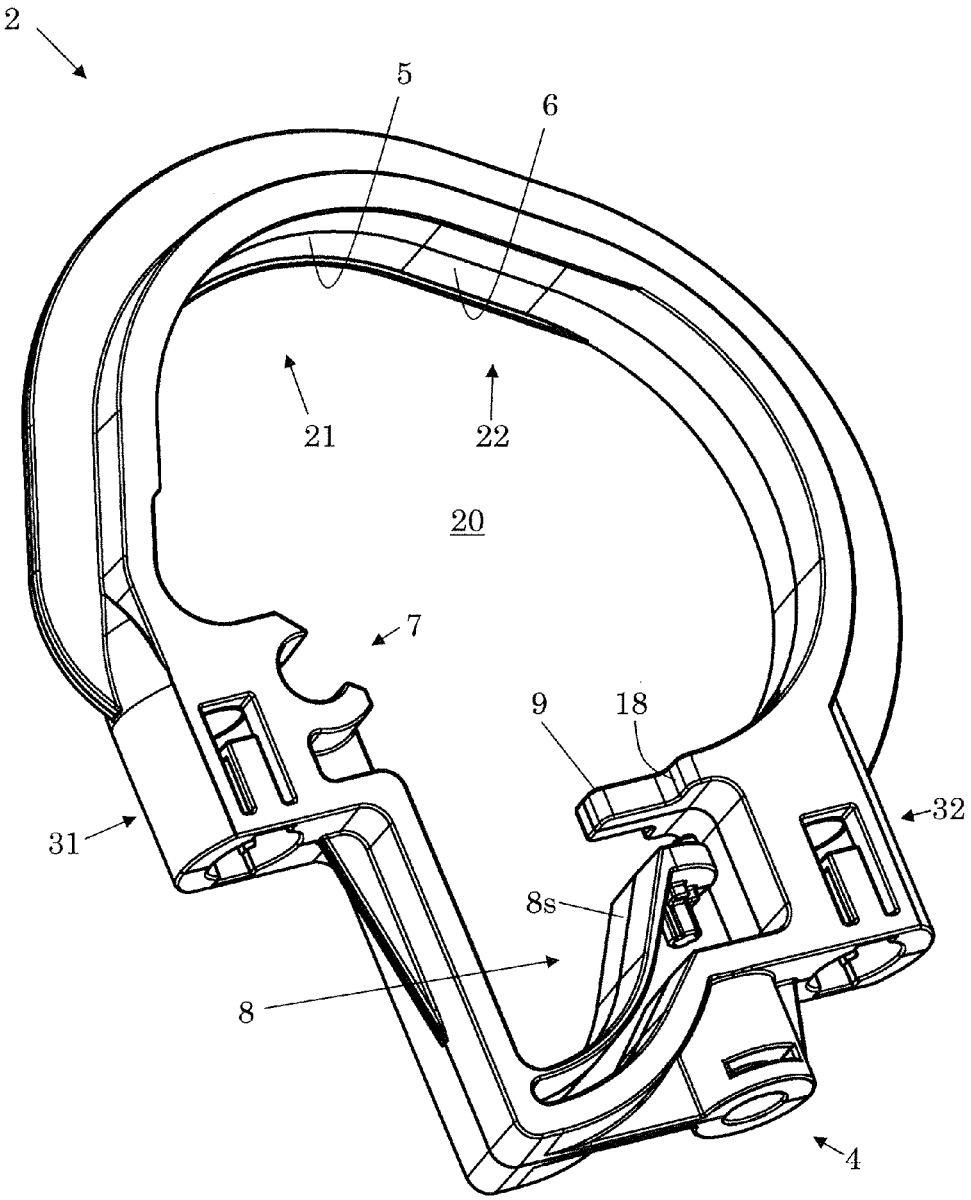
FIG. 2 a perspective view of the hose cartridge of FIG. 1.
Figure 3:
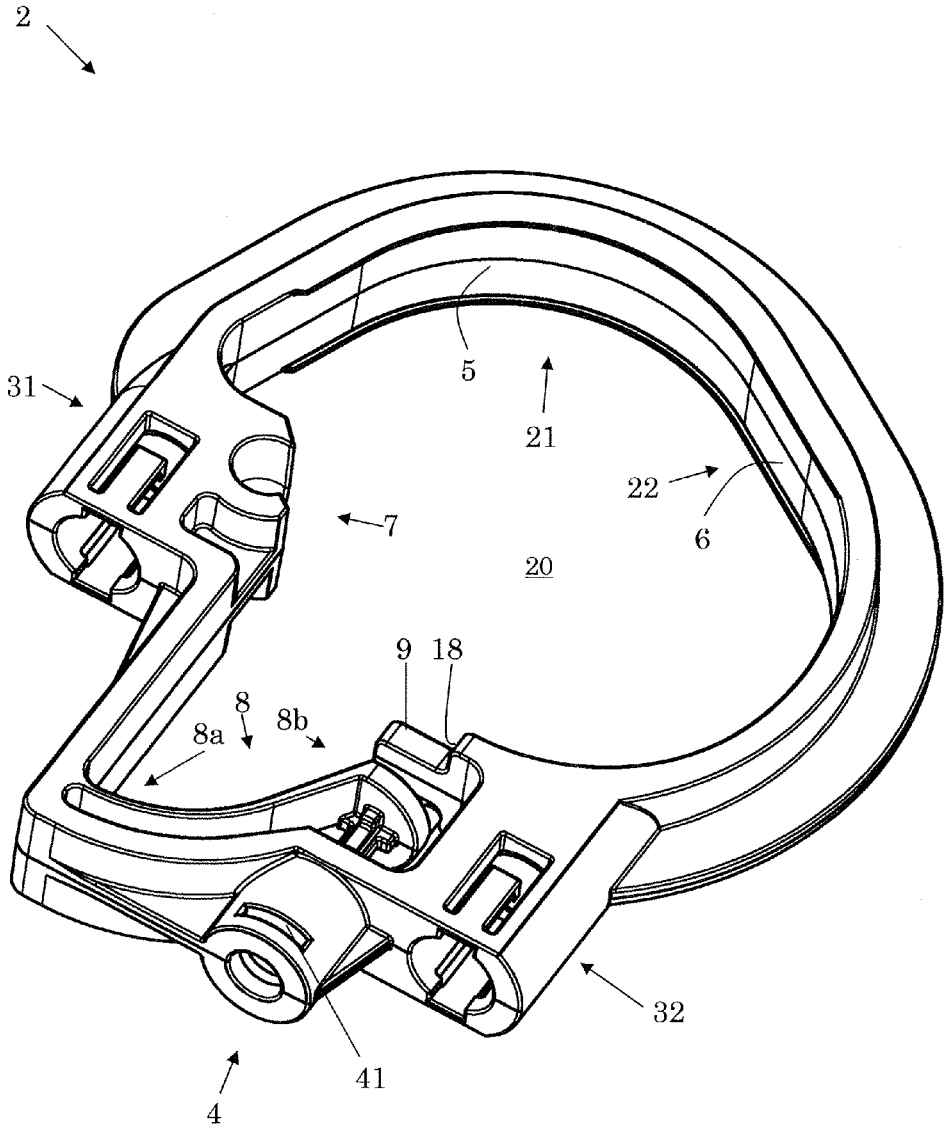
FIG. 3 a perspective view of the hose cartridge of FIGS. 1 and 2.

FIG. 1 shows a front view of a hose cartridge 2, and FIGS. 2 and 3 show the same hose cartridge 2 in different perspective views. For reasons of visibility, the hose cartridge is drawn with no hose mounted; only in FIG. 1, the bold dashed line (labelled h) schematically indicates the approximate position of a mounted hose h.

Figure 4:
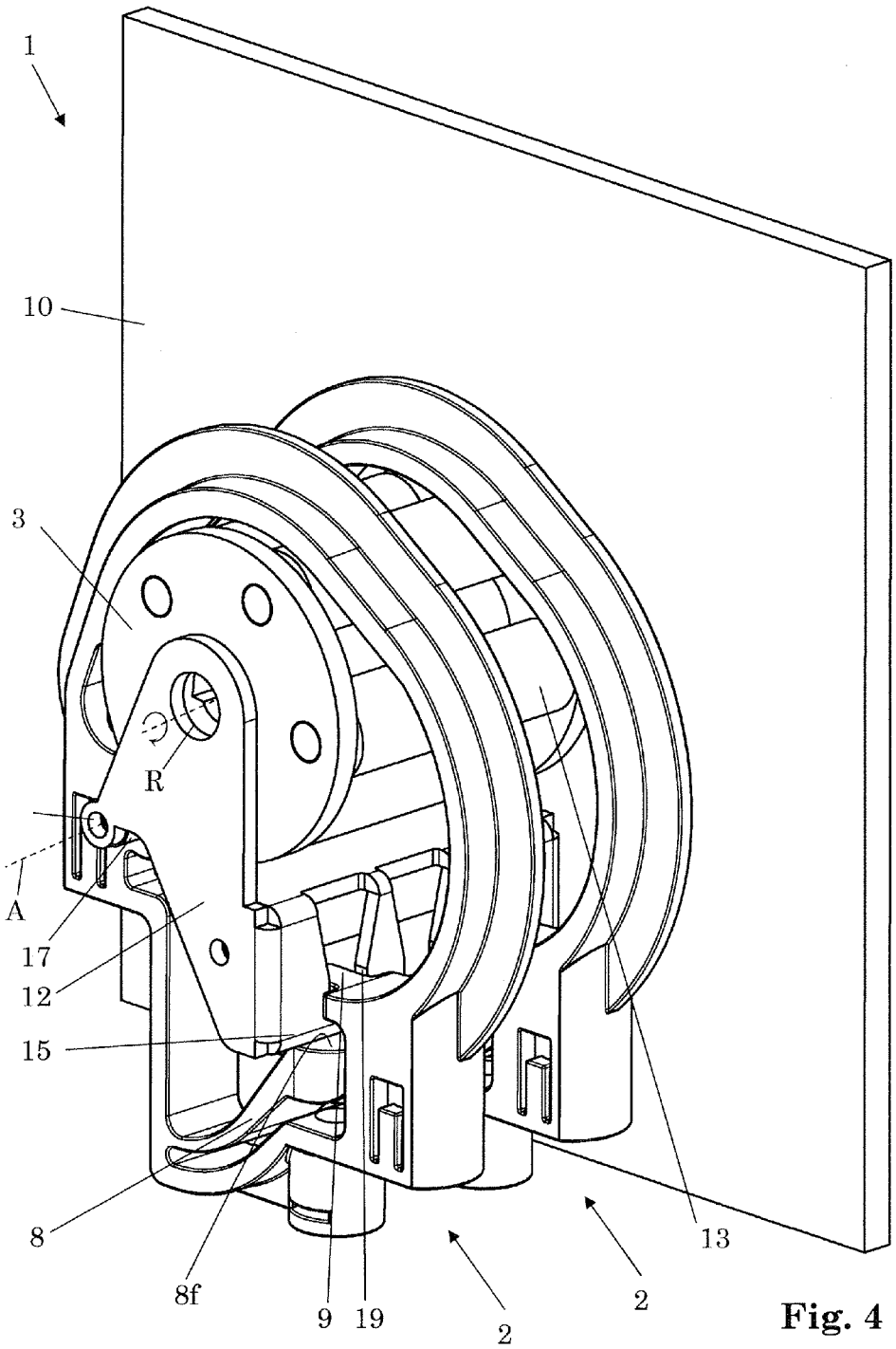
FIG. 4 a perspective view of a detail of a peristaltic pump, with mounted hose cartridge, but no hose shown.
Figure 5:
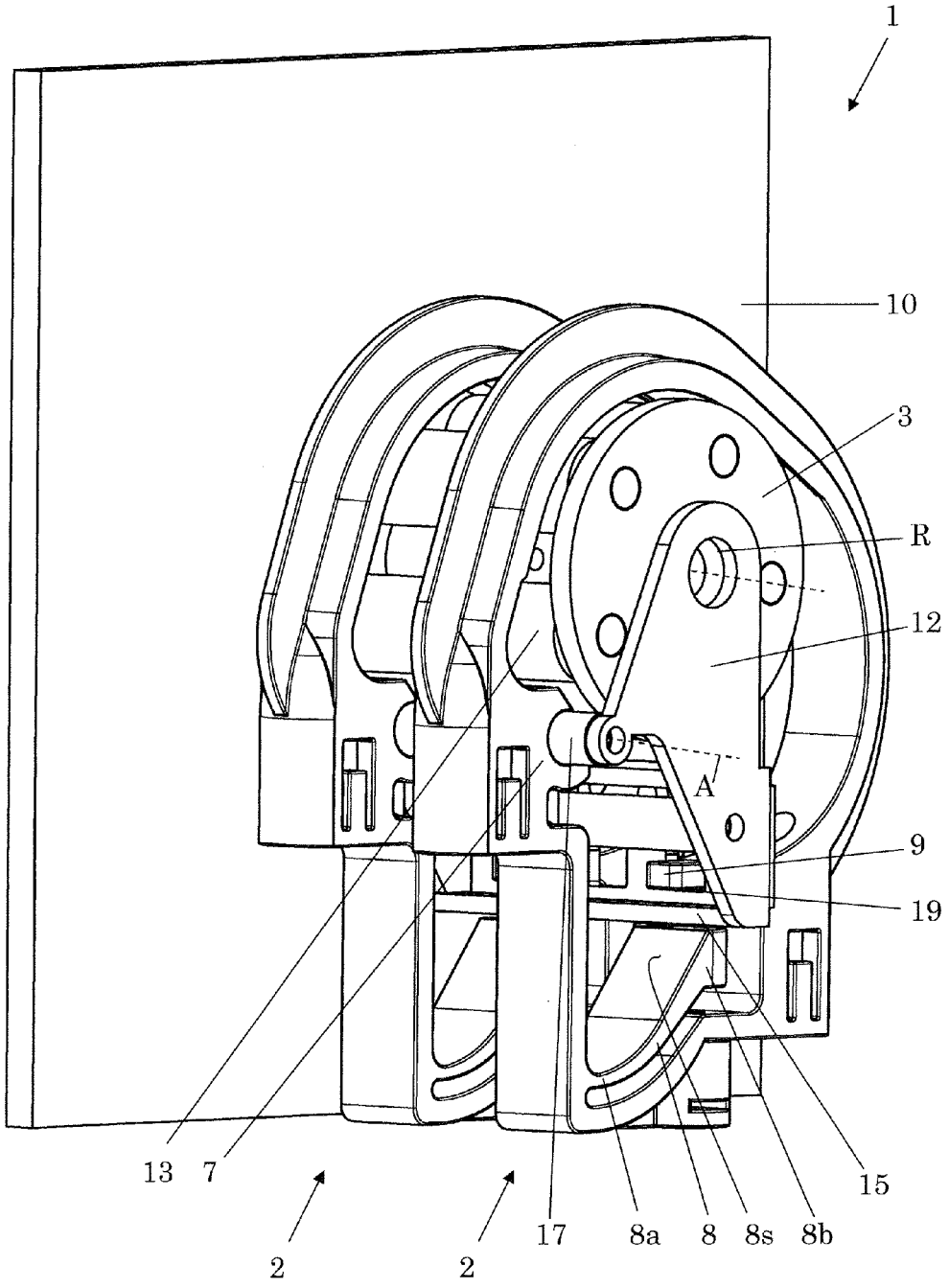
FIG. 5 a perspective view of the detail of the peristaltic pump of FIG. 4.

The following description generally refers to FIGS. 1 to 5, wherein details of the peristaltic pump 1 are shown in FIGS. 4 and 5 only. FIGS. 4 and 5 show perspective views of a detail of a peristaltic pump 1, with mounted hose cartridge 2, but no hose h shown.

The hose cartridge 2 generally describes a closed-loop shape. It is generally ring-shaped, wherein "ring" does not imply a round shape. The opening surrounded by hose cartridge 2 is referred to as receiving opening 20; when mounted on peristaltic pump 1, the roller wheel 3 is located within receiving opening 20.

Roughly, the hose cartridge 2 can be considered to comprise two parts, a frame portion and a stabilizing portion, the first roughly above the large-dotted straight line in FIG. 1, the latter roughly below that line. The frame portion generally describes a C-shaped bow and in particular has a substantially T-shaped cross-section.

Hose cartridge 2 comprises a first hose fixing location 31 and a second hose fixing location 32. A hose h such as a flexible tube can be fixed there. For example, hose h can be provided with a hose coupling at each of its ends, and the hose couplings are fixed at the first and second hose fixing locations 31 and 32, respectively. Material to be pumped could then be guided, e.g., using another hose (feed line) provided with a corresponding hose coupling, to the hose cartridge 2, more particularly to hose h and even more particularly to that end of hose h fixed at first hose fixing location 31. This is indicated by the open arrow pointing at first hose fixing location 31.

Using, e.g., yet another hose (drain or outlet line), the material to be pumped could be guided away from hose cartridge 2 in a similar manner, see also the open arrow pointing away from second hose fixing location 32 indicating the run-off direction of pumped material. Again, corresponding couplings could be used for attaching an end of that hose to that end of hose h which is fixed at second fixing end 32.

Roughly along the path of hose h between its places of fixation 31,32, the frame portion of hose cartridge 2 comprises firstly and close to first hose fixing location 31 a first frame section 21 and then a second frame section 22. Frame section 21 describes, within the cartridge plane (which in FIG. 1 is the drawing plane) a substantially circular shape, at which the active section of hose h is compressed by the rollers 13 of the roller wheel 3 of the peristaltic pump 1 on which it is mounted. Accordingly, first frame section 21 provides and comprises the occlusion surface 5 of hose cartridge 2, which is aligned substantially perpendicularly to the cartridge plane.

Neighboring first frame section 21, a second frame section 22 is arranged which comprises a surface 6 neighboring occlusion surface 5 and which can, as shown in FIGS. 1 to 3, be aligned substantially perpendicularly to the cartridge plane. Surface 6 has, within the cartridge plane, a curvature which is smaller than the curvature of occlusion surface 5. The main reason for this is that this allows to mount hose cartridge 2 on peristaltic pump 1 by means of rotating hose cartridge 2, as will become apparent below.

Another frame section completes the frame portion towards second hose fixing end 32.

Stabilizing portion, arranged roughly opposite to the frame portion, interconnects the two hose fixing locations 31,32 and comprises a holding portion 7, a lever portion 8 and a spring member 4. These function together with parts of the peristaltic pump 1, namely in particular with fixing bar 15 and holding rod 17.

For mounting hose cartridge 2 on peristaltic pump 1, hose cartridge 2 (being provided with a hose h) is moved such that roller wheel 3 penetrates receiving opening 20. Then, holding rod 17 is pushed through a sideways opening of holding portion 7 such that hose cartridge 2 is rotatably clamped on holding rod 17. Holding rod 17 defines an axis A along its extension. With hose cartridge 2 clamped on holding rod 17, that axis A is positioned approximately as indicated in FIG. 1.

When hose cartridge 2 is now rotated in the direction indicated by the small arrow near axis A in FIG. 1, it will be able to enter its final (mounted) position. In this working position, hose h will, generally in the region of the first frame section 21, be positioned (and compressed) between roller wheel 3 and occlusion surface 5. The angle covered in this rotation typically is below 180°, more typically below 120°, in the case shown in the Figs. even below 90°.

From this, it is clear, that said second frame section 22 has to be shaped so as to provide space for the roller wheel 3 in the initial cartridge position (in which it is moved over roller wheel 3, holding rod 17 and fixing bar 15 and from which the working position is entered by rotating about axis A in the described manner).

During the rotation of hose cartridge 2, fixing bar 15 interacts with lever portion 8, which again interacts with spring member 4. Spring member 4 comprises a spring 40 (only schematically indicated in FIG. 1 as curved dashed line), a spring-receiving volume 42 in which a portion of the spring is located, and a slot 41 and a spring-fixing member such as a piece of sheet metal located in said slot 41 (not shown), which ensures that spring 40 remains between the fixing member and a spring-loaded end 8*b* of lever portion 8.

Lever portion 8 comprises a fixed end at which it is fixed at the rest of hose cartridge 2 (more particularly at the fixing portion), and said spring-loaded end 8*b*. Therebetween, a sliding surface 8*f* and a fixing surface 8*f* is formed by lever portion 8. On the opposite side of sliding surface 8*f*, a nose is provided which holds spring 40 in place.

In a first phase of the rotation of hose cartridge 2, fixing bar 15 will slide on sliding surface towards spring-loaded end 8*b*. By that, spring 40 of spring member 4 will be compressed, thus building up a mechanical tension. In a subsequent phase, rotation continues until the edge formed between sliding surface 8*s* and fixing surface 8*f* is passed and fixing bar 15 is in contact with fixing surface 8*f*. The working position is reached. The angle $\alpha$ between the surfaces 8*f* and 8*s* is between 180° and 270°, more particularly between 200° and 260°.

In the working position, spring member 4 (and more particularly spring 40) exerts a force which keeps hose cartridge 2 in a well-defined fixed position with respect to peristaltic pump 1. This ensures a well-defined tension at the hose h, which provides a good precondition for well-defined and reproducible pumping action. For unmounting hose cartridge 2 from peristaltic pump 1, one will rotate hose cartridge 2 in the opposite direction, and a force has to be applied which is sufficiently high to further compress spring 40 and to move over the edge between the surfaces 8*s* and 8*f*.

In order to intrinsically limit the rotational movement of hose cartridge 2 during mounting, a stop member 18 is provided which is stopped by fixing bar 15 (cf. FIG. 4). Close to stop member 18, a nose-like axial positioning member 9 is provided which interacts with a positioning slit 19 of fixing bar 15. This allows to ensure that hose cartridge 2 is located in a well-defined axial position and furthermore minimizes the danger that hose cartridge 2 is axially tilted during pumping operation. The term "axial" refers to the direction of the rotation axis R of the roller wheel 3 of the peristaltic pump 1. Note that the rotation axis R is drawn in FIGS. 4 and 5 as if it were transparent.

As shown in FIGS. 4 and 5, it is possible to provide that more than one, e.g., 3, 4, or 5, hose cartridges 2 can be mounted on one peristaltic pump 1, or more particularly, on one roller wheel. In this case, an appropriate number of positioning slits 19 will have to be provided.

In order to provide a stabilization for the rotation axis R, a fixing plate 12 is provided which interconnects and mutually fixes to each other rotation axis R, holding rod 17 and fixing bar 15, all at their ends distal from a front plate 10 of a housing of peristaltic pump 1.

The invention allows to mount a hose cartridge 2 on a peristaltic pump 1 and to unmount a hose cartridge 2 from a peristaltic pump 1 in an innovative way, by means of a rotating movement. Good pumping stability and reproducibility can be achieved, and in a simple way, great mechanical stability of hose cartridge 2 and of peristaltic pump 1 is achieved.

LIST OF REFERENCE SYMBOLS

1 peristaltic pump
2 hose cartridge
3 roller wheel
4 spring member
5 occlusion surface
6 surface
7 holding portion
8 lever portion
8*a* fixed end
8*b* spring-loaded end
8*f* fixing surface
8*s* sliding surface
9 axial-positioning member
10 front plate, portion of peristaltic pump housing
12 fixing plate
13 roller
15 fixing bar
17 holding rod
18 stop member
19 positioning slit
20 receiving opening
21 first frame section
22 second frame section
31 first hose fixing location
32 second hose fixing location
40 spring
41 slot (for spring-fixing member)
42 spring-receiving volume
A axis
h hose (schematically)
R rotation axis
α angle

The invention claimed is:

1. A hose cartridge (2) for removably mounting a hose on a peristaltic pump comprising a roller wheel (3) for pumping a fluid through said hose and a holding rod(17) and a fixing bar (15), the hose cartridge (1) comprising:

parallel to a rotation axis (R) of said roller wheel (3), said hose cartridge (2) substantially describing a closed loop encircling an opening through which said roller wheel (3) extends when the hose cartridge (2) is mounted on the peristaltic pump (1), the hose cartridge (2) being rotatably clamped on the holding rod (17) of the peristaltic pump, wherein said hose cartridge is rotatable around an axis defined by said holding rod to move within said opening between an initial cartridge position and a working position in which said hose is compressed between said roller wheel and said hose cartridge, wherein said holding rod and said fixing bar extend through said opening (20).

2. The hose cartridge (2) according to claim 1, which is at least substantially integrally formed or at least substantially consists of an integrally formed main part and an additional spring member (4) or one or more parts of a spring member (4) attached to said main part.

3. The hose cartridge (2) according to claim 1, comprising a first frame section (21) forming an occlusion surface (5) having an at least substantially circular curvature and a second frame section (22) neighboring said first frame section (21) and forming a surface (6) neighboring said occlusion surface (5) and having a curvature less strong than said substantially circular curvature, wherein said occlusion surface compresses said hose.

4. The hose cartridge (2) according to claim 1, comprising a holding portion (7) for rotatably fixing the hose cartridge (2) on a holding rod (17) of the peristaltic pump (1).

5. The hose cartridge (2) according to claim 4, wherein said holding portion (7) fully or partially encircles a shape substantially describing a cylinder jacket.

6. The hose cartridge (2) according to claim 1, comprising a spring member (4) and a lever portion (8), said lever portion (8) comprising:

a fixed end (8*a*) at which the lever portion (8) is fixed to substantially the rest of the hose cartridge (2);

a spring-loaded end (8*b*), spring-loaded by said spring member (4);

at said spring-loaded end (8*b*), a fixing surface (8*f*); and, between said fixed end (8*a*) and said fixing surface and neighboring said fixing surface (8*f*), a sliding surface (8*s*);

said fixing surface (8*f*) and said sliding surface (8*s*) forming an angle (*a*) of substantially larger than 180°.

7. Method for mounting a hose cartridge (2) comprising a hose (*h*) onto a peristaltic pump (1) comprising a roller wheel (3) for pumping a fluid through said hose (h) and a holding rod (17) and a fixing bar (15), said holding rod (17) and said fixing bar (15) both extending substantially parallel to a rotation axis (R) of said roller wheel (3), said method comprising the steps of:

b) introducing said holding rod (17) into a holding portion (7) of said hose cartridge (2);

c) carrying out a rotational movement of said hose cartridge (2) about an axis (A) defined by said holding rod (17) until a working position of the hose cartridge (2) is reached, wherein during step c), by means of said rotational movement, said fixing bar (15) is slided over a sliding surface (8*s*) of a lever portion (8) of the hose cartridge (2), and, by further rotating said hose cartridge (2) about said axis (A) defined by said holding rod (17), a fixing surface (8*f*) of said lever portion (8) is pressed, by means of a spring member (4) of said lever portion (8), against said fixing bar (15), thus holding said hose cartridge (2) in said working position.

8. Method for mounting a hose cartridge (2) comprising a hose (h) onto a peristaltic pump (1) comprising a roller wheel (3) for pumping a fluid through said hose (h) and a holding rod (17) and a fixing bar (15), said holding rod (17) and said fixing bar (15) both extending substantially parallel to a rotation axis (R) of said roller wheel (3), said method comprising the steps of:

b) introducing said holding rod (17) into a holding portion (7) of said hose cartridge (2);

c) carrying out a rotational movement of said hose cartridge (2) about an axis (A) defined by said holding rod (17) until a working position of the hose cartridge (2) is reached, said hose cartridge (2) comprising a receiving opening (20), said method comprising, before step b), the step of a) moving said hose cartridge (2) with said receiving opening (20) over said rotation axis (R), said holding rod (17) and said fixing bar (15), such that the latter extend through said receiving opening (20).

* * * * *